United States Patent [19]

Aguilar

[11] 4,443,051

[45] Apr. 17, 1984

[54] TELEPHONE JACK

[75] Inventor: Hector V. Aguilar, Monterey Park, Calif.

[73] Assignee: American Telecommunications Corp., El Monte, Calif.

[21] Appl. No.: 174,541

[22] Filed: Aug. 1, 1980

[51] Int. Cl.[3] ..... H01R 13/58

[52] U.S. Cl. ..... 339/107; 339/119 R

[58] Field of Search ..... 339/103 R, 103 M, 105, 339/107, 126, 156 R, 119 R; 179/1 PC, 186

[56] References Cited

U.S. PATENT DOCUMENTS

| | | | |
|---|---|---|---|
| 4,088,384 | 5/1978 | Gumb | 339/156 R X |
| 4,169,648 | 10/1979 | Moist | 339/103 R |
| 4,220,391 | 9/1980 | Krolak et al. | 339/126 R |

OTHER PUBLICATIONS

Western Electric, Technical Digest No. 61, Jan. 1981, p. 3 IBM Technical Disclosure Bulletin, vol. 15, No. 1, Jun. 1972, p. 109.

*Primary Examiner*—Joseph H. McGlynn

*Attorney, Agent, or Firm*—Christie, Parker & Hale

[57] ABSTRACT

A telehone jack comprises a jack frame and socket having a plug receiving cavity in which a plurality of contacts lie, a cable comprising a plurality of wires connected at one end to the respective contacts, and a housing partially enclosing the frame and socket. A cable extends externally from the frame and socket. The housing has a first opening that exposes the cavity and a second opening through which the cable passes. A pair of spaced apart tabs formed on the exterior of the housing are secured by a tie wrap or bracket to a telephone set to mount the jack thereon. The housing comprises a lower portion and an upper portion that lock together when the housing is assembled. One of the portions has a first interior partition with a straight edge, the other portion has a second interior partition having in abutment with the straight edge of the first partition an edge with an arch-shaped opening. The cable is received in the arch-shaped opening with a tight fit so that the partitions together provide stress relief therefor. The cable has a 90° bend directing a portion of the cable along the length of one of the partitions from the arch-shaped opening to the second opening in the housing.

12 Claims, 8 Drawing Figures

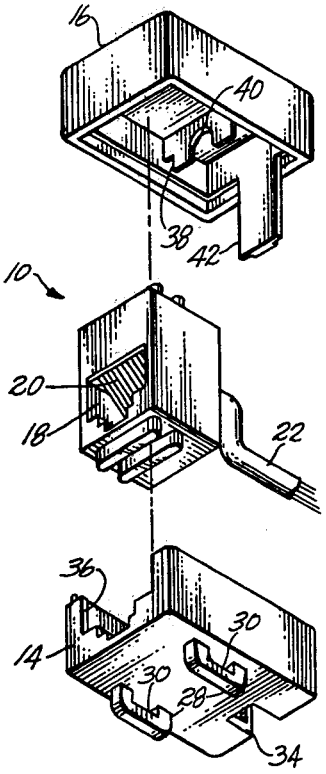
Fig. 1A
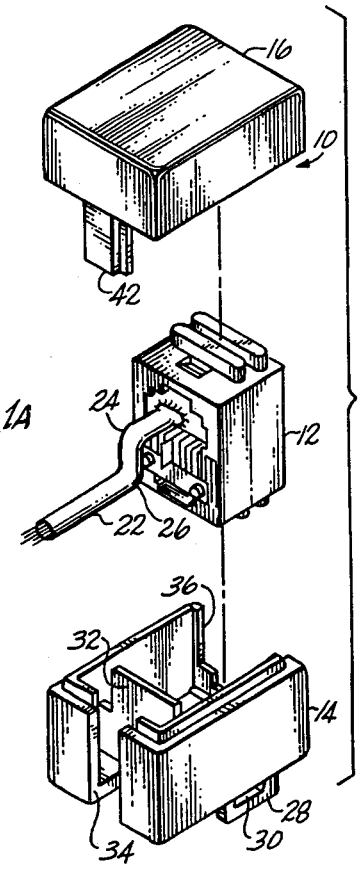
Fig. 1B
Fig. 2
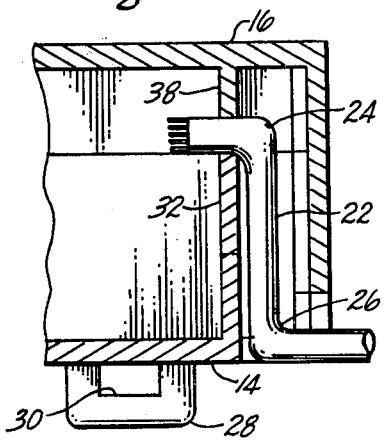
Fig. 3
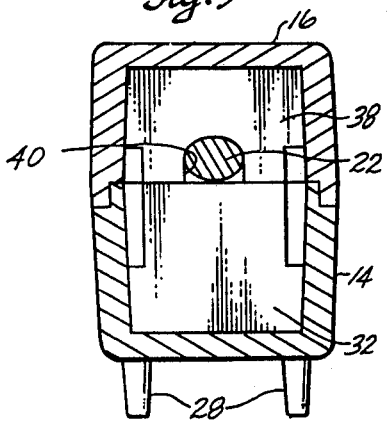

Fig. 4
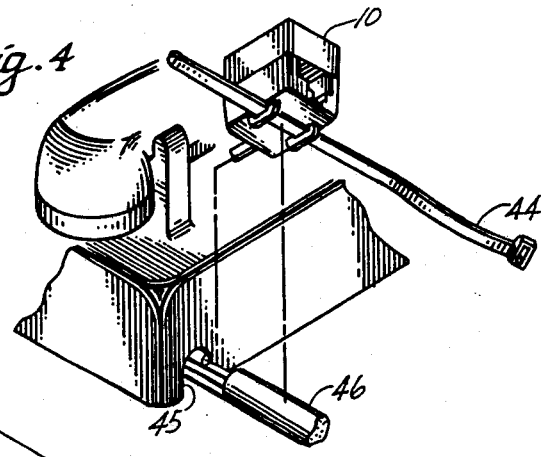
Fig. 5
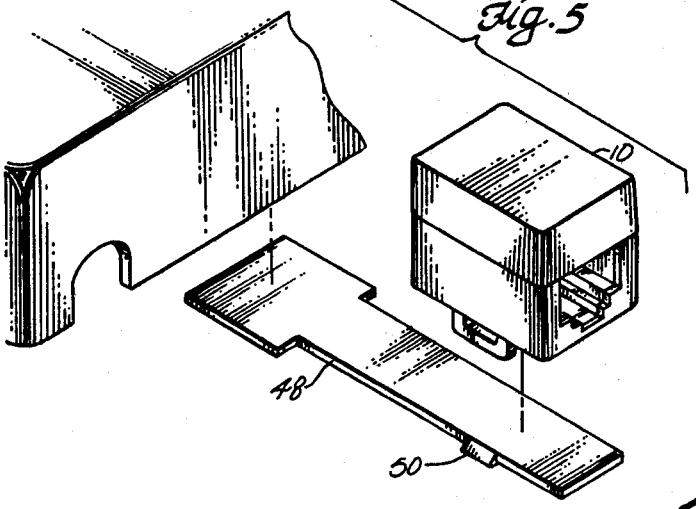
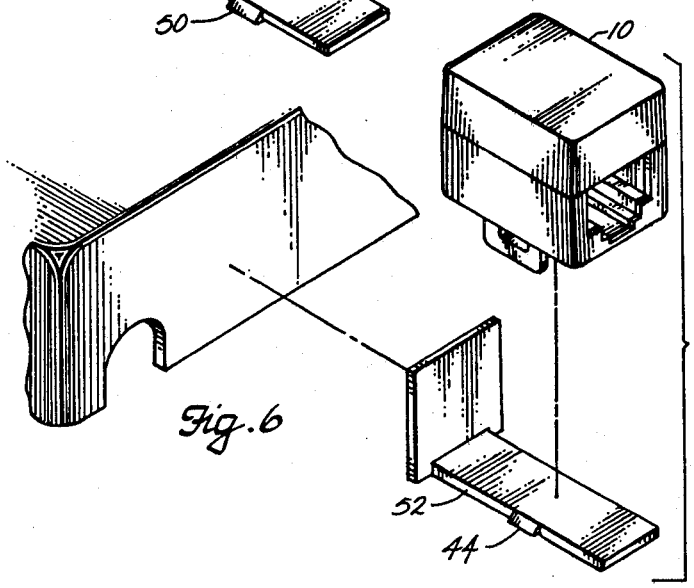
Fig. 6
Fig. 7
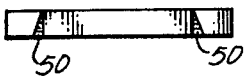

TELEPHONE JACK

BACKGROUND OF THE INVENTION

This invention relates to telephone accessories and, more particularly, to a jack for permanent installation on a telephone set.

Telephone users sometimes wish to connect auxiliary equipment, for example an automatic dialer, to a telephone set. This is most conveniently done through a permanent jack installed on the telephone set. Such a jack should be small, ruggedly constructed, and securely mounted on the telephone set.

SUMMARY OF THE INVENTION

According to one aspect of the invention, a telephone jack comprises a jack frame and socket having a plug receiving cavity in which a plurality of contacts lie, a cable comprising a plurality of wires connected at one end to the respective contacts, and a housing partially enclosing the frame and socket. The cable extends externally from the frame and socket. The housing has a first opening that exposes the cavity and a second opening through which the cable passes. A pair of spaced apart tabs formed on the exterior of the housing are secured to a telephone set to mount the jack thereon.

According to another aspect of the invention, a telephone jack comprises a jack frame and socket having a plug receiving cavity in which a plurality of contacts lie, a cable comprising a plurality of wires connected at one end to the respective contacts, and a housing comprising a lower portion and an upper portion that lock together when the housing is assembled. One of the portions has a first interior partition with a straight edge. The other portion has a second interior partition, having in abutment with the straight edge of the first partition, an edge with an arch-shaped opening. The cable is received in the arch-shaped opening with a tight fit so that the partitions together provide stress relief therefor. The cable has a 90° bend directing a portion of the cable along the length of one of the partitions from the arch-shaped opening to the cable egress opening in the housing.

BRIEF DESCRIPTION OF THE DRAWINGS

The features of a specific embodiment of the best mode contemplated of carrying out the invention are illustrated in the drawings, in which:

FIGS. 1A and 1B are exploded perspective views of a telephone jack depicting the principles of the invention;

FIG. 2 is a side sectional view of the jack of FIG. 1;

FIG. 3 is an end sectional view of the jack of FIG. 1;

FIGS. 4 through 6 depict alternative arrangements for mounting the jack of FIG. 1 on a telephone set; and FIG. 7 is an end elevation view of the bracket of FIG. 5 illustrating the tapered ears.

DETAILED DESCRIPTION OF THE SPECIFIC EMBODIMENT

With reference to FIGS. 1, 2, and 3, a telephone jack 10 comprises a jack frame and socket 12 partially enclosed by a two-piece housing comprising a lower portion 14 and an upper portion 16. The front of frame and socket 12, which is a conventional, commercially available component in the telephone industry, has a plug receiving cavity 18 in which a plurality of contacts 20 lie. A cable 22 comprising a plurality of wires connected at one end to the respective contacts 20 extends outwardly from the back of frame and socket 12. Cable 22 has a pair of right angle bends 24 and 26, extending horizontally away from the top of frame and socket 12, vertically downward to form bend 24, and then horizontally away from the bottom of frame and socket 12 to form bend 26.

A pair of external tabs 28 having respective openings 30 extend downwardly from the bottom of lower portion 14 in laterally spaced apart relationship. An interior partition 32 extends vertically upward from the bottom interior of lower portion 14 near the back thereof. Partition 32 has a straight top edge. A slot 34 is formed in the back and bottom of lower portion 14 rearward of partition 32. An opening 36 that exposes cavity 18 is formed in the front of lower portion 14.

A tongue 42 extends downwardly from the back side of upper portion 16 to fit in slot 34 when the housing is assembled, thereby forming an approximately cubicle opening at the bottom rear edge of the housing for egress of cable 22.

An internal partition 38 extends vertically downwardly from the top interior of upper portion 16 near the back thereof. When the housing is assembled, the bottom edge of partition 38 abuts the tope edge of partition 32. An arch-shaped opening 40 formed in the lower edge of partition 38 and the adjacent portion of the top edge of partition 32 receive cable 24 with a tight fit so that partitions 32 and 38 together serve as a cable clamp and provide stress relief for cable 24. Cable 22 passes along the surface of partition 32 to the cubicle opening. Thus, partition 32 with tongue 42 serves to guide cable 22 and confine it to an interior space rearward of frame and socket 14.

Along the back and sides the outside of lower portion 14 is recessed at its upper edge. Along the back and sides the inside of upper portion 16 is recessed at its lower edge, which abuts the upper edge of lower portion 14. Along its sides, the outside of tongue 42 is recessed and along its sides, the inside of slot 34 is recessed. These recesses are dimensioned so lower portion 14 and upper portion 16 fit together in interlocking relationship. The recesses on lower portion 14 are provided with a number of dimples and the recesses on upper portion 16 are provided with a number of matching indentations that receive the dimples with an interference fit that locks lower portion 14 and upper portion 16 together when the housing is assembled. If desired, the abutting surfaces of lower portion 14 and upper portion 16 could also be bonded together, such as for example with cement or by fusion.

The described telephone jack can be mounted on a telephone set in a number of different ways. In any case, the cover of the telephone set is removed and the wires of cable 22 are connected to the circuitry therein in the desired manner. After the cover is replaced, cable 22 is routed to the telephone jack through the cable access opening at the back of the cover, represented by reference numeral 45 in FIGS. 4 through 6. As illustrated in FIG. 4, one mounting arrangement for jack 10 is to thread a conventional plastic tie wrap 44 of the type commonly used to bundle wire into wire harnesses through openings 30 and to strap tie wrap 44 around the telephone line cord, represented by reference numeral 46. There are formed along the length of tie wrap 44 serrations that engage a tooth formed in a loop at one end of tie wrap 44 when the other end thereof is inserted in the loop. When tie wrap 44 is cinched, the tooth and serrations serve as a ratchet to prevent the tie wrap from loosening.

As illustrated in FIG. 5, jack 10 can be mounted on the telephone set by means of a flat bracket 48 which has ears 50 extending horizontally from its sides near one end. As shown in FIG. 7, ears 50 are tapered, i.e., they are triangular in cross section, extending the maximum distance from the sides of bracket 48 at the bottom horizontal surface thereof and being flushed with the top horizontal surface thereof. Ears 50 engage openings 30 in an interference fit, thereby securing the jack to one end of bracket 48; the other end of bracket 48 is cemented to the bottom of the telephone set by a conventional adhesive structure, such as for example a small double-stick pad.

As illustrated in FIG. 6, jack 10 can be mounted on the telephone set by means of an L-shaped bracket 52, which has tapered ears 54 extending horizontally from its sides near one end. The upright portion of bracket 52 is cemented to the back surface of the telephone set by a conventional adhesive structure such as for example a small double stick pad.

The invention thus provides cable stress relief in a compact telephone jack that can be conveniently mounted on a telephone set.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention.

What is claimed is:

1. A telephone jack comprising:

a jack frame and socket having a plug-receiving cavity in which a plurality of contacts lie;

a cable comprising a plurality of wires connected at one end to the respective contacts, the cable extending externally from the frame and socket;

a housing partially enclosing the frame and socket, the housing having a first opening that exposes the cavity and a second opening through which the cable passes;

a pair of spaced apart tabs formed on the exterior of the housing, each tab having an opening; and means for securing the tabs to a telephone set to mount the jack thereon.

2. The jack of claim 1, in which the securing means comprises a tie wrap threaded through the openings in the tabs to strap the jack around a line cord of a telephone set.

3. The jack of claim 1, in which the securing means comprises a bracket having ears extending horizontally from its sides near one end, the ears being adapted to engage the openings of the tabs in an interference fit, and means for attaching the bracket to a telephone set.

4. The jack of claim 3, in which the ears are tapered.

5. The jack of claim 4, in which the bracket is flat.

6. The jack of claim 4, in which the bracket is L-shaped.

7. The jack of claim 1, in which the housing comprises a lower portion and an upper portion that lock together when the housing is assembled, one of the portions having a first interior partition with a straight edge, the other portion having a second interior partition having an edge in abutment with the straight edge of the first partition and an arch-shaped opening, the cable being received in the arch-shaped opening with a tight fit so that the partitions together provide stress relief for the cable, the cable having a 90° bend directing a portion of the cable along the length of one of the partitions from the arch-shaped opening to the second opening in the housing.

8. The jack of claim 7, in which the cable has a 90° bend at the second opening.

9. A telephone jack comprising:

a jack frame and socket having a plug-receiving cavity in which a plurality of contacts lie;

a cable comprising a plurality of wires connected at one end to the respective contacts, the cable extending externally from the frame and socket; and a housing partially enclosing the frame and socket, the housing comprising a lower portion and an upper portion that lock together when the housing is assembled, one of the portions having a first interior partition with a straight edge, the other portion having a second interior partition having an edge in abutment with the straight edge of the first partition and an arch-shaped opening, the cable being received in the arch-shaped opening with a tight fit so that the partitions together provide stress relief for the cable, the housing having a first opening that exposes the cavity and a second opening through which the cable passes, the cable having a 90° bend directing a portion of the cable along the length of one of the partitions from the arch-shaped opening to the second opening in the housing.

10. The telephone jack claimed in claim 9 wherein:

the partitions are spaced interiorly of the second opening to define an interior space bounded by the partitions and exterior walls of the housing portions and which receives a portion of the cable, the second opening is spaced out-of-line from the arch-shaped opening, the 90° bend occurs adjacent the arch-shaped opening, and a second 90° bend occurs at the second opening.

11. The telephone jack claimed in claim 10 wherein one of the housing portions has a slot opposite the arch-shaped opening and the other housing portion has a tongue received in the slot to confine the portion of the cable in the interior space.

12. The telephone jack claimed in claim 11 including a pair of spaced apart tabs on the exterior of the housing, and tie wrap means for securing the tabs to a telephone set to mount the jack thereon.

* * * * *